US010937622B2

(12) United States Patent
Michalski et al.

(10) Patent No.: US 10,937,622 B2
(45) Date of Patent: Mar. 2, 2021

(54) PROGRAMMABLE PERFORMANCE CONFIGURATIONS FOR NIGHT VISION DEVICE

(71) Applicant: Eagle Technology, LLC, Melbourne, FL (US)

(72) Inventors: Mark Michalski, West Springfield, MA (US); Ransom Hal Castleberry, Blacksburg, VA (US); John A. Balboni, Agawam, MA (US); Arlynn W. Smith, Blue Ridge, VA (US); Raymond Leo Chabot, Chicopee, MA (US)

(73) Assignee: ELBIT SYSTEMS OF AMERICA, LLC, Fort Worth, TX (US)

( * ) Notice: Subject to any disclaimer, the term of this patent is extended or adjusted under 35 U.S.C. 154(b) by 198 days.

(21) Appl. No.: 16/225,082

(22) Filed: Dec. 19, 2018

(65) Prior Publication Data

US 2020/0203112 A1 Jun. 25, 2020

(51) Int. Cl.

| | |
|---|---|
| ***H01J 29/96*** | (2006.01) |
| ***H01J 29/04*** | (2006.01) |
| *H01J 29/02* | (2006.01) |
| *H01J 31/50* | (2006.01) |

(52) U.S. Cl.

CPC ..... *H01J 29/96* (2013.01); *H01J 29/04* (2013.01); *H01J 29/023* (2013.01); *H01J 31/507* (2013.01); *H01J 2231/5016* (2013.01)

(58) Field of Classification Search

CPC ..... H01J 29/96; H01J 29/04; H01J 29/023; H01J 31/507; H01J 2231/5016

See application file for complete search history.

(56) References Cited

U.S. PATENT DOCUMENTS

| | | | | |
|---|---|---|---|---|
| 4,882,481 | A | 11/1989 | Gilligan et al. | |
| 5,146,077 | A | 9/1992 | Caserta et al. | |
| 6,278,104 | B1 | 8/2001 | Saldana et al. | |
| 6,320,180 | B1 | 11/2001 | Estrera et al. | |
| 7,141,777 | B1 | 11/2006 | Brillhart | |
| 7,696,462 | B2 | 4/2010 | Saldana | |
| 2009/0072749 | A1 | 3/2009 | Saldana | |
| 2009/0108180 | A1 * | 4/2009 | Saldana | H01J 31/507 250/214 VT |
| 2011/0101224 | A1 | 5/2011 | Kim | |
| 2014/0001344 | A1 | 1/2014 | Lewis | |

FOREIGN PATENT DOCUMENTS

| | | |
|---|---|---|
| KR | 1019950702392 | 7/1995 |
| WO | 2007050201 | 5/2007 |
| WO | 2014008199 | 1/2014 |

OTHER PUBLICATIONS

International Search Report and Written Opinion issued to PCT/US2019/066807, dated Oct. 28, 2020, 14 pages.

* cited by examiner

*Primary Examiner* — Georgia Y Epps
*Assistant Examiner* — Don J Williams
(74) *Attorney, Agent, or Firm* — K&L Gates LLP

(57) ABSTRACT

A method of controlling the performance of a night vision device includes storing, in memory of the night vision device, a plurality of performance configuration parameters, and after the storing, applying at least one of a hardware lock and a software lock to the night vision device such that at least some of the plurality of performance configuration parameters stored in the memory cannot be changed.

16 Claims, 10 Drawing Sheets

PROGRAMMABLE PERFORMANCE CONFIGURATIONS FOR NIGHT VISION DEVICE

FIELD OF THE INVENTION

The present invention relates to a night vision device, to a power supply for a night vision device, and, more specifically, to digital and software techniques to configure the performance of a night vision device.

BACKGROUND

A night vision device may be used in many industrial and military applications. For example, such a device may be used for enhancing the night vision of aviators, for photographing astronomical bodies and for providing night vision to soldiers or sufferers of retinitis pigmentosa (night blindness). The device often incorporates an image intensifier that is used to amplify low intensity light or to convert non-visible light into readily viewable images. One such image intensifier is an image intensifier tube.

An image intensifier tube typically includes a photocathode, with for example, a gallium arsenide (GaAs) active layer and a microchannel plate (MCP) positioned within a vacuum housing. Visible and infrared energy, for example, may impinge upon the photocathode and be absorbed in the cathode active layer, thereby resulting in generation of electron/hole pairs. The generated electrons are then emitted into the vacuum cavity and amplified by the MCP.

More specifically, when electrons exit the photocathode, the electrons are accelerated toward an input surface of the MCP by a difference in potential between the input surface of the MCP and the photocathode of approximately 200 to 900 volts depending on the MCP to cathode spacing and MCP configuration (filmed or un-filmed). As the electrons bombard the input surface of the MCP, secondary electrons are generated within the MCP. That is, the MCP may generate several hundred electrons for each electron entering the input surface. The MCP is also subjected to a difference in potential between its input surface and its output surface that is typically 700-1200 volts. This potential difference enables electron multiplication in the MCP.

As the multiplied electrons exit the MCP, the electrons are accelerated through the vacuum cavity toward a phosphor screen (or other anode surface) by yet another difference in potential between the phosphor screen and the output surface of the MCP. This latter potential may be on the order of approximately 4200-5400 volts.

A power supply integrated, or potted, with the image intensifier tube is generally used to generate and provide the various potential differences noted above, and to still further provide control voltages for various components of the image intensifier tube. The power supply and intensifier tube are expected to operate under a variety of lighting conditions, including, e.g., relatively low light or relatively high light conditions. Configuring and controlling a power supply to handle all these conditions is a challenge. In addition, it may be desirable to supply night vision equipment with differing levels of performance. For example, in certain cases, the performance of a night vision device might need to be constrained or degraded to meet export restrictions.

SUMMARY

Described herein are methods of controlling the performance of a night vision device. The method includes storing, in memory of the night vision device, e.g., a plurality of performance configuration parameters, and voltage control algorithms and, after the storing, applying at least one of a hardware lock and a software lock to the night vision device such that at least some of the plurality of performance configuration parameters stored in the memory cannot be changed.

In another embodiment, a method of controlling the performance of a night vision device includes storing, in memory of the night vision device, control logic and a plurality of performance configuration parameters that are used by the control logic when the control logic is executed, blowing a physical fuse in the night vision device such that at least portions of the control logic stored in the memory cannot be changed, and applying a software lock to the night vision device such that at least some of the plurality of performance configuration parameters stored in the memory cannot be changed.

In still another embodiment, a power supply for a light intensifier of a night vision device includes power supply circuitry that is configured to supply control voltages to the image intensifier, a memory configured to store control logic and parameters that control performance and a processor, wherein the processor is configured to execute the control logic including applying a gating duty factor to the cathode control voltage, in accordance with the performance parameter settings, such that the performance of the night vision device is degraded in comparison to the performance of the night vision device without having the gating duty factor applied.

BRIEF DESCRIPTION OF THE DRAWINGS

Like reference numerals have been used to identify like elements throughout this disclosure.

DETAILED DESCRIPTION

Figure 1:
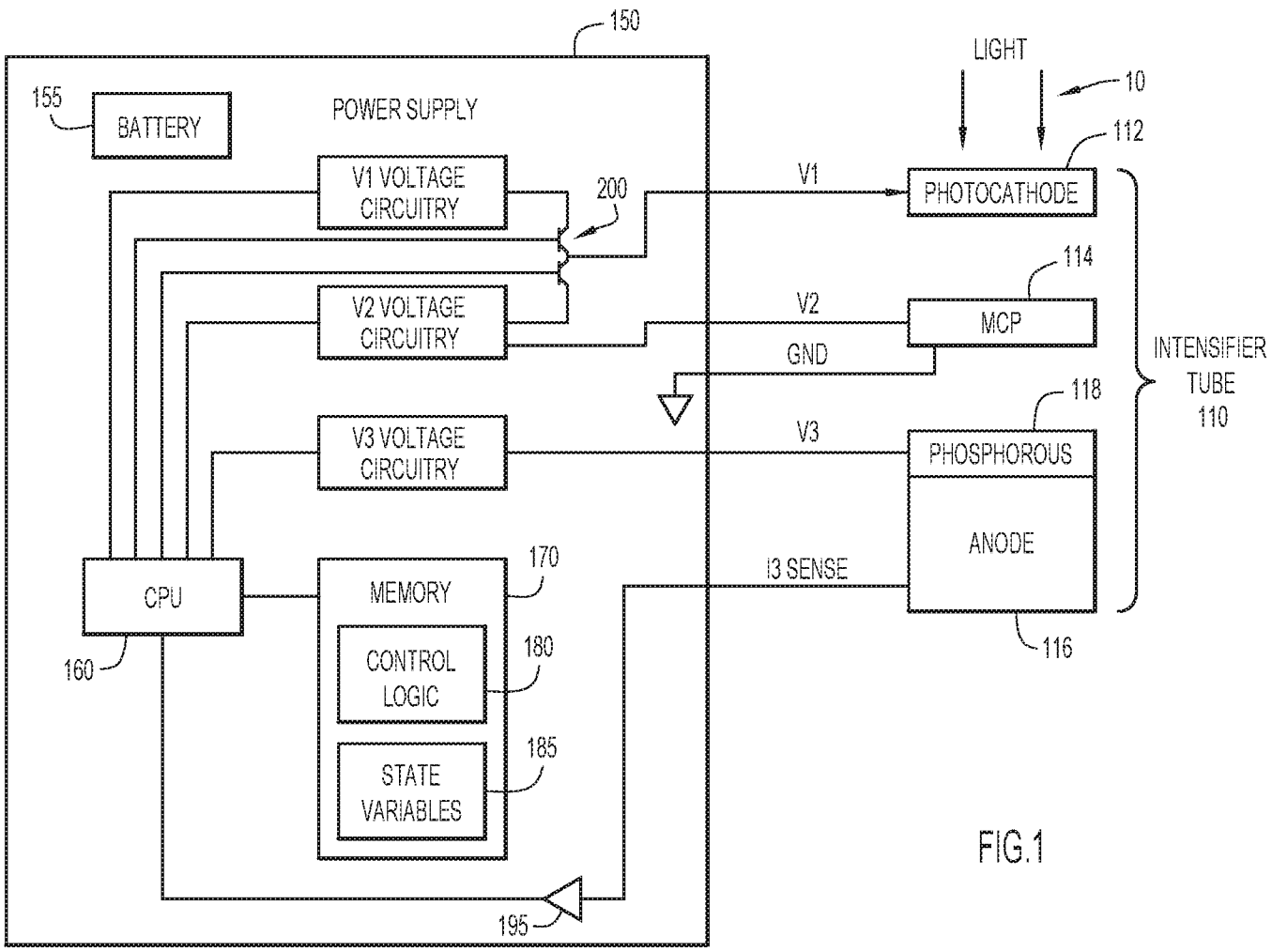
FIG. 1 is a block diagram of a digitally controlled power supply and associated image intensifier in accordance with an embodiment of the present invention.

FIG. 1 is a block diagram of a digitally controlled power supply and associated image intensifier in accordance with an embodiment of the present invention. Specifically, FIG. 1 depicts an image intensifier tube 110 that is powered and controlled by a digitally controlled power supply 150. Intensifier tube 110 includes a photocathode 112, a microchannel plate (MCP) 114 and an anode 116 that includes a phosphor layer 118.

Digitally controlled power supply (or simply "power supply") 150 includes a battery 155, or other energy source, that supplies power that is used by the power supply 150 itself and that is delivered to the intensifier tube 110. The power supply 150 further includes a central processing unit (CPU) 160 and memory 170, which stores, among other things, control logic 180 and state variables (or settings) 185 (discussed further below). Battery 155 supplies power for each of the control voltages V1, V2, and V3, which are respectively applied to components of the intensifier tube 110. The values of these control voltages may be set by CPU 160 in accordance with instructions received from control logic 180 and/or values stored as state variables or settings 185.

In one possible implementation, CPU 160 controls circuitry that controls the application of voltages V1, V2, V3 to the photocathode 112, MCP 114 and anode 116, respectively. An operational amplifier 195 is configured to sense current I3 flowing in anode 116. Current I3 is representative of the brightness of the light 10 being received at photocathode 112 only where V1 and V2 are not being modified to control the output brightness of the phosphor screen. A value of current I3 can be used by control logic 180 and CPU 160 to, for example, adjust the value of V1 or V2 (e.g., higher V1 or V2 for higher brightness, and lower V1 or V2 for lower brightness).

An advantage of a digitally controlled power supply 150 is that the control scheme which adjusts the output brightness of the intensifier tube 110, as a function of input light 10, can be selected after the power supply is built, unlike a conventional analog power supply where the control scheme is built into the hardware. Digital control of the power supply 150 allows adjustment of different parameters or settings to activate certain features and/or to ensure that the night vision device complies with, e.g., export restrictions. Digital control of the power supply 150 can also be used to compensate performance parameters in view of temperature and/or usage. Functions and related performance parameters/settings that can be controlled by power supply 150 are described below.

Fixed Brightness Control

Figure 2:
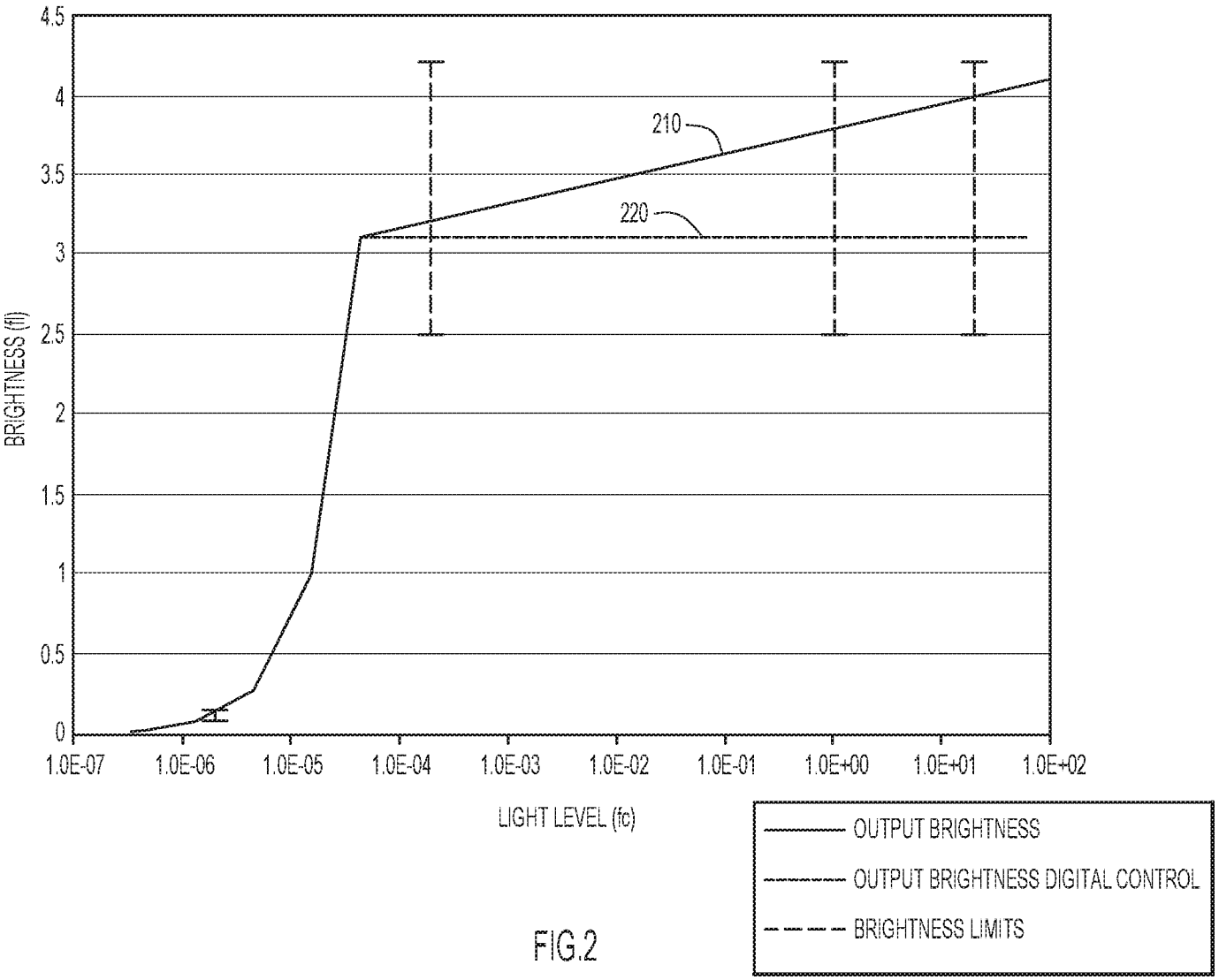
FIG. 2 shows plots of output brightness versus light level in accordance with an embodiment of the present invention.

One function of the power supply 150 and control logic 180 is to control the output brightness of the intensifier tube 110 as a function of input light level to protect the user from the intensified scene becoming overly bright. In this regard, FIG. 2 shows plots of output brightness versus light level in accordance with an embodiment of the present invention. As shown, the output brightness, beyond a predetermined level of received light, is held nearly fixed (between predetermined brightness limits), but, in the case of a typical analog power supply, and as shown by curve 210, nevertheless tends to rise slightly due to the inherent operation of analog circuitry.

On the other hand, with digital control, embodiments of the present invention can generate an output brightness versus light level curve 220 similar to curve 210 but, without the slow rise of curve 210. That is, curve 220 shows that brightness remains truly fixed after about $1\times10^{-5}$ fc (foot candle). This steady brightness output is a result of the control logic 180 that drives control voltages (e.g., photocathode control voltage V1 and MCP control voltage V2) to create a zero differential between the screen current (I3) and a fixed value current to achieve the desired screen brightness. A discussion of control voltage manipulation is provided below.

Photocathode Protection and Audible Emission Minimization

Figure 3:
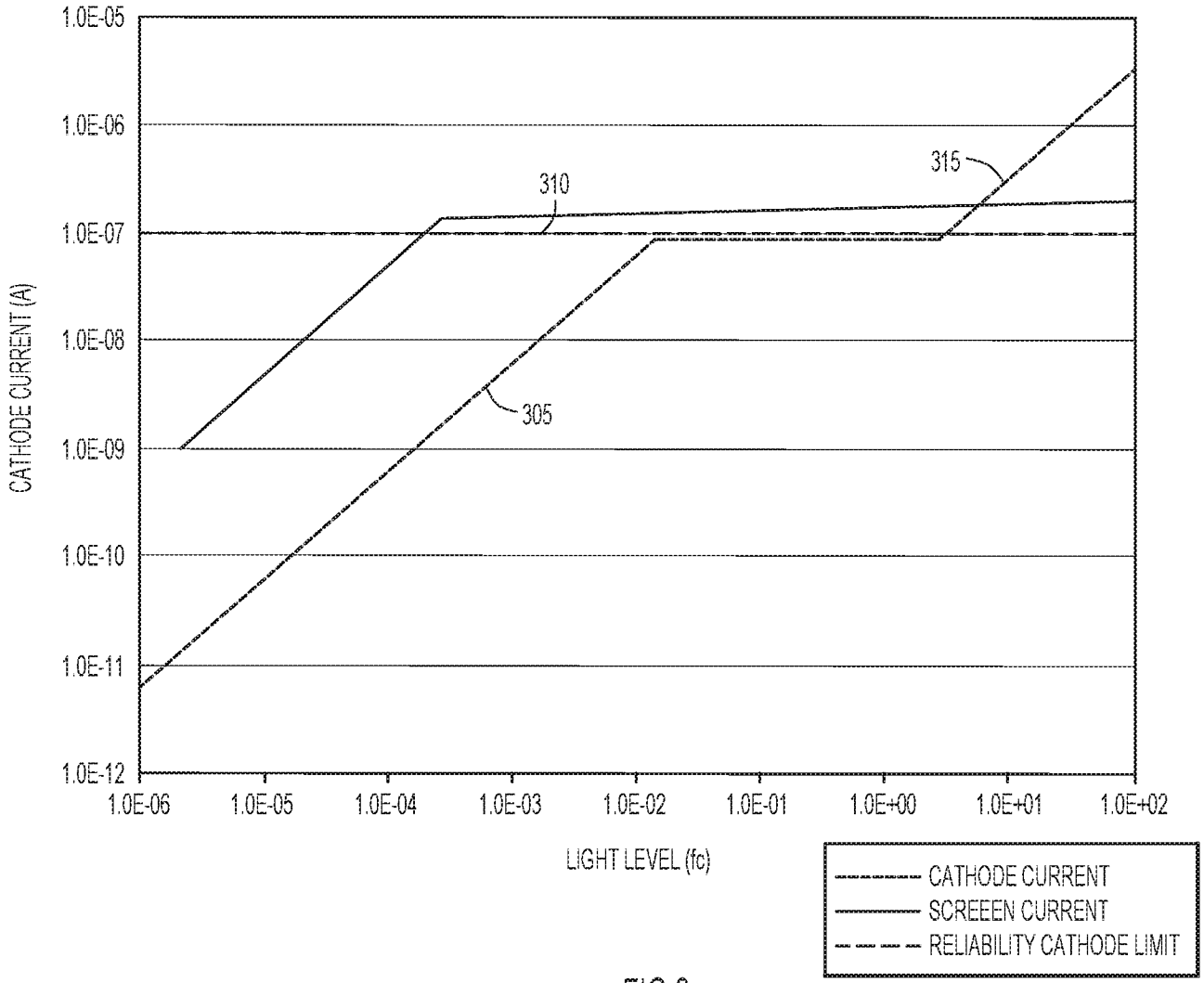
FIG. 3 depict plots of photocathode current in response to different photocathode control voltages (V1) in accordance with embodiments of the present invention.

Another function of the power supply 150 is to protect the photocathode 112 from damage by bright lights which may permanently damage the sensitive photo conversion layer of the intensifier tube 110. FIG. 3 depict plots of photocathode current in response to different photocathode control voltages (V1) in accordance with embodiments of the present invention.

As shown in FIG. 3, the photocathode current rises linearly 305 with light level even after it passes a limit 310 at which experiments have shown that device lifetime is compromised. As will be explained in more detail in connection with FIG. 4, and in accordance with an embodiment of the invention, the control logic 180 is configured to decrease photocathode voltage V1 at an appropriate time from a high value to a lower value to limit the photocathode current. Generally, a higher value of V1 is selected to give a desired SNR at lower light levels, while a lower value of V1 is selected at higher light levels to provide enough energy that photoelectrons can begin a gain cascade in the MCP (otherwise the intensifier tube would shutoff). Once V1 has been adjusted down to a lower control voltage, the photocathode voltage V1 can then be gated to maintain the photocathode current at the desired level. At some point the duty factor of the gating cannot be reduced any further and the photocathode cathode current will start to rise 315 above the safe cathode current range 310, as shown in FIG. 3. Notwithstanding, the output brightness will not increase to a user because the power supply 150 is further configured to adjust the MCP control voltage V2 to maintain the output brightness at an appropriate level until V2 reaches its minimum value.

Figure 4:
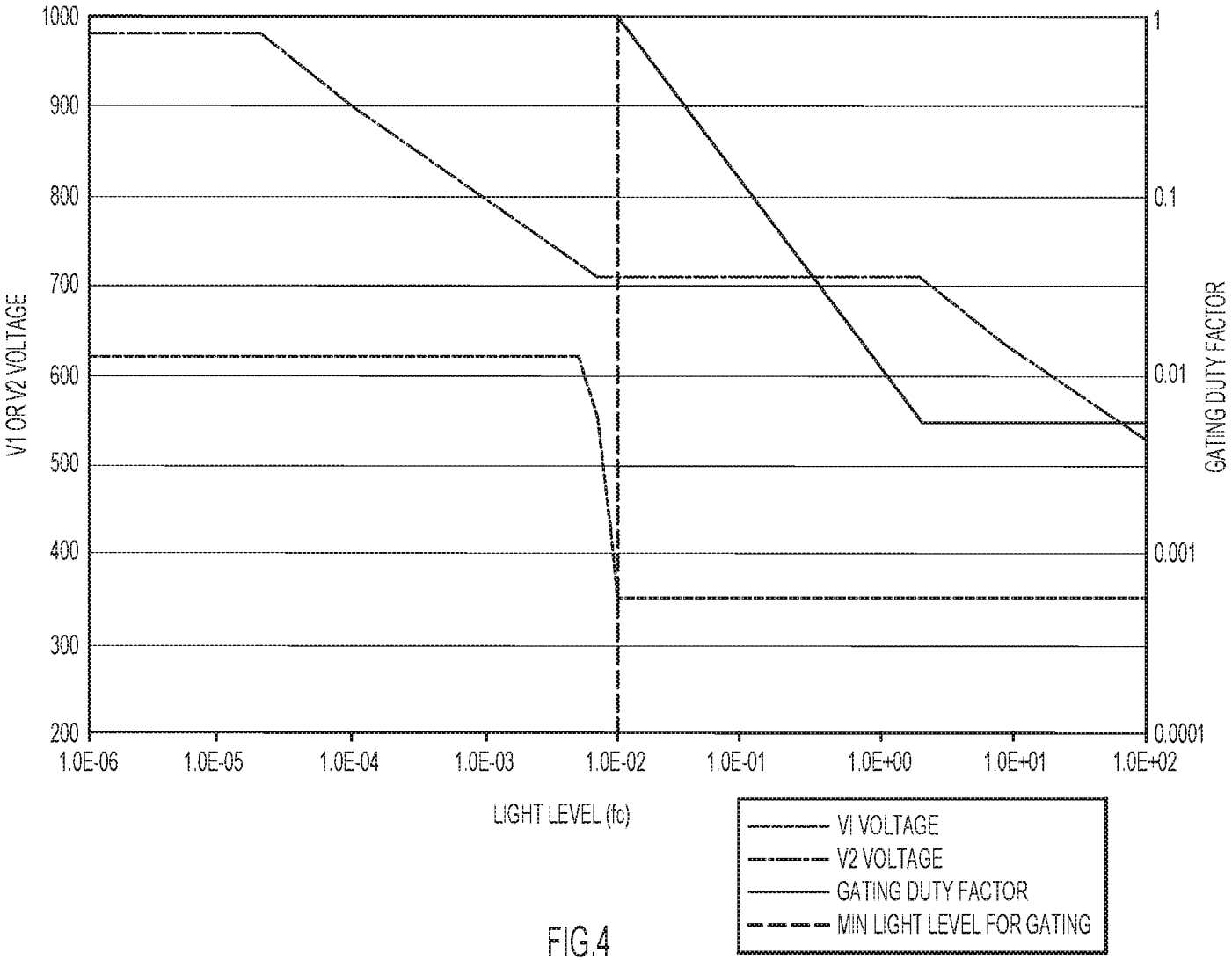
FIG. 4 depicts a control scheme for photocathode control voltage V1 and microchannel plate control voltage (V2) in accordance with an embodiment of the present invention.

FIG. 4 depicts a control scheme for photocathode control voltage V1 and microchannel plate control voltage V2 in accordance with an embodiment of the present invention. In the scheme, and in accordance with one possible implementation, only one control element (V1, V2, cathode duty factor) is actively controlled at any given time.

In accordance with an embodiment of the invention, upper and lower voltage set points of the V1 and V2 voltages are adjustable via stored settings 185. In the case of FIG. 4, V2 is lowered as the light level increases to some fixed value below the low light set point, shown from $2.0\times10^{-5}$ fc to about $5\times10^{-3}$ fc. This first adjustment of V2 is the V2 range of brightness control. Once this adjustment range runs out, the V1 voltage is reduced to its lowest value. At this point, the duty factor for photocathode gating is changed to maintain the output brightness. Finally, once the range of duty factor has reached its minimum, V2 is decreased again until the power supply 150 reaches another minimum V2. An advantage of this scheme is that the photocathode voltage V1 is not gated (unity duty factor) until a fairly high light level. This is significant because the gating voltage can be the cause of audible emissions from intensifier tube 110.

That is, electrostatic force caused by the gating deforms the microchannel plate and, as the force is released by the off phase of the duty factor, the plate relaxes in its support. This moving and rubbing of the components can cause audible emissions. By limiting when gating voltage is applied, the range of light for which audible emissions may be present is minimized. The V1, V2, and gating control described above also maintains a higher level of SNR by adjusting the voltage V2 first, rather than first adjusting the V1 control voltage. Different schemes of applying the V1, V2 and gating control factors are also possible and are still within the scope of the present invention.

Photocathode Voltage Gating and Waveform Manipulation

Figure 5:
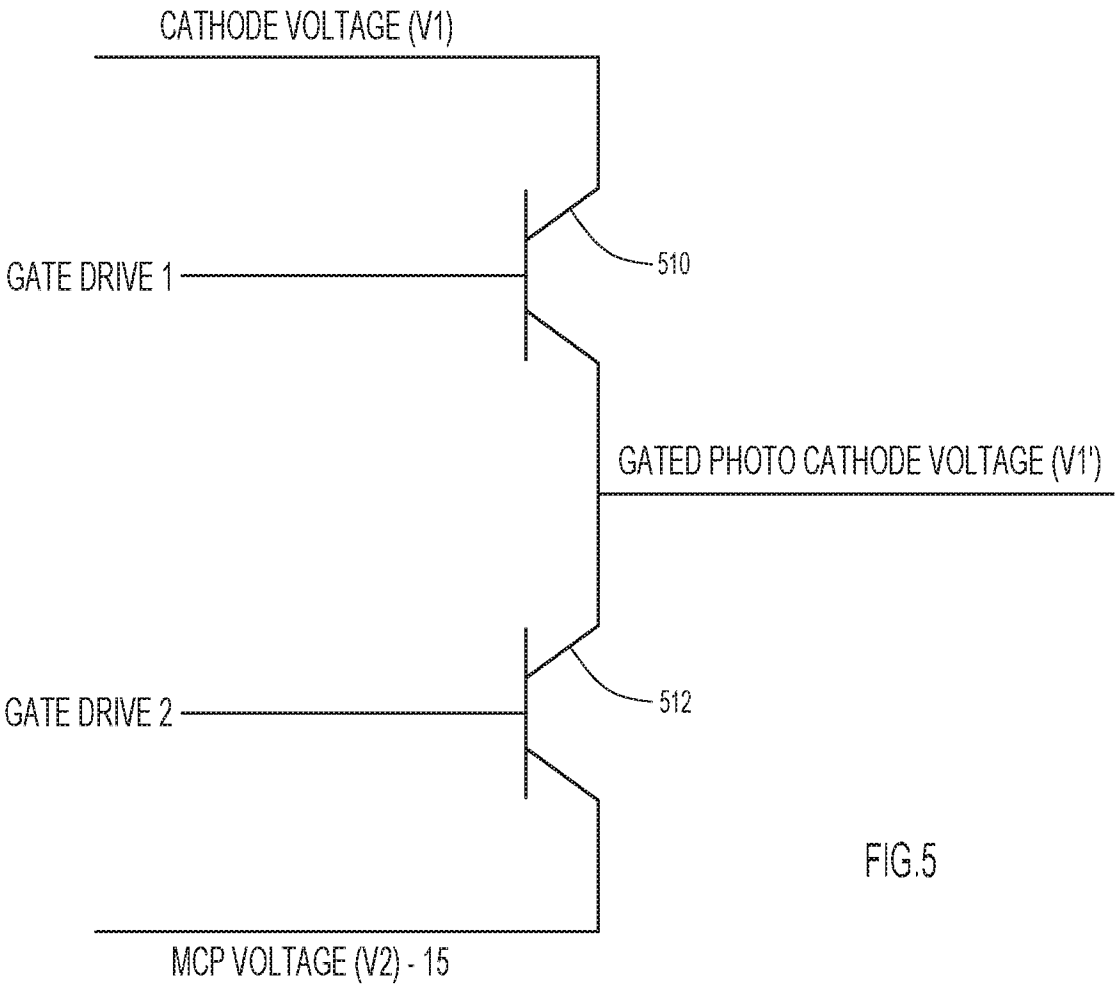
FIG. 5 is a circuit diagram of a switch configuration used to control application of a photocathode control voltage (V1) in accordance with an embodiment of the present invention.

FIG. 5 is a circuit diagram of a switch configuration used to control application of a photocathode control voltage V1 in accordance with an embodiment of the present invention. One advantage of using a digitally controlled power supply 150 is the ability not only to switch various voltages on or off, but also to manipulate the waveform(s) of, e.g., the photocathode voltage V1 and/or other control voltages. In this regard, FIG. 5 depicts an approach to connect the photocathode 112 to the V1 supply voltage, and to further provide gating functionality for V1. As shown, the photocathode 112 connection is placed between two high voltage transistors 510, 512 which can isolate the photocathode 112 from the two control voltages. In one possible implementation, presented here, the off state of the photocathode 112 is the MCP voltage V2 minus an offset (e.g., 15 volts) to ensure the photocathode 112 experiences a hard reset or reverse bias state.

In operation of the switch configuration of FIG. 5, both gate drives (gate drive 1, gate drive 2) are controlled such that they are not on at the same time, otherwise the photocathode supply voltage V1 would be shorted to the MCP supply voltage V2. The circuit allows the photocathode 112 to be supplied with a gated photocathode voltage V1' that is set to the supply cathode voltage V1 by turning on gate drive 1. When transistor 510 is on, the photocathode voltage is fixed. If gate drive 1 is off, the gated photocathode voltage V1' floats. The cycling of the gate drive 1 signal to transistor 510 may be referred to as an "update frequency" or "refresh rate" of the intensifier tube 110. An update frequency parameter or refresh rate parameter may be stored as one of the state variables or settings 185 and can be used by CPU 160 to operate the intensifier tube 110. Opening gate drive 2 pulls the gated photocathode voltage V1' to V2—15V, or reverse biases the photocathode 112. This stops any photocathode current from reaching the MCP 114, effectively shutting off an output of the intensifier tube 110.

Figure 6A:
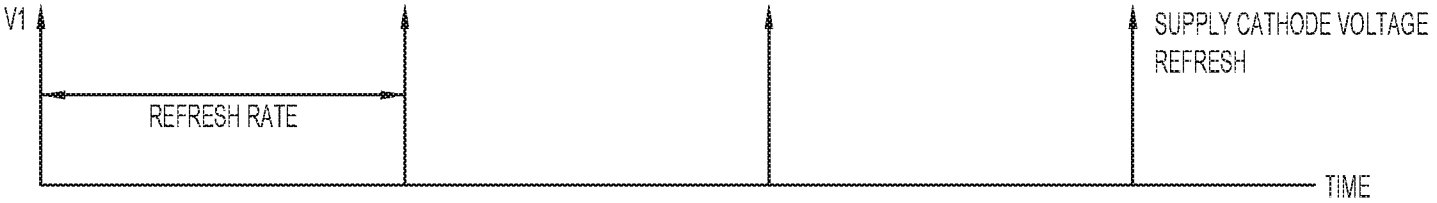
FIGS. 6A-6C show traces that depict, respectively, a refresh rate of the photocathode supply, the photocathode control voltage (V1') at low light level, and the photocathode control voltage (V1') voltage at high light level in accordance with an embodiment of the present invention.
Figure 6B:
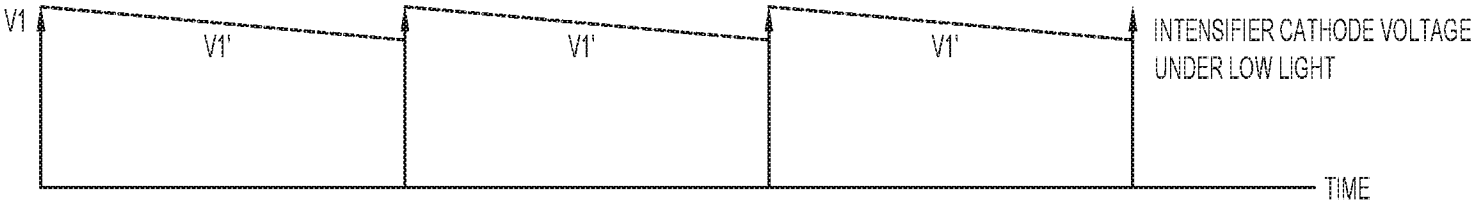
Figure 6C:
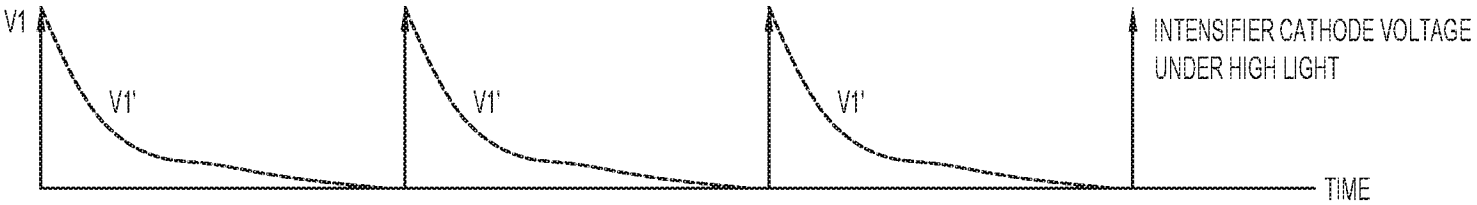

Control logic 180 of power supply 150 can take advantage of the reaction of the V1' voltage in response to gate control as the light level changes. In all cases discussed below, when the gate drive 1 is engaged to charge the intensifier voltage to V1, i.e., set V1' to V1, the gate drive 2 transistor is off. Within the intensifier tube photocathode circuit there is an inherent capacitance and resistance. Once the gate drive 1 is off, the charge in the capacitance is drained off by the photocurrent of the cathode. This drops the V1' voltage from the initial set point of V1. The level of photocurrent dictates how fast the intensifier voltage decreases. If gate drive 1 is not engaged, then the intensifier voltage would eventually decay to the MCP voltage V2. One mode of operation is with the gate drive 1 open for the majority of the time. FIGS. 6A-6C show three traces that depict the refresh rate of the photocathode supply (FIG. 6A), the V1' voltage at low light level (FIG. 6B), and the VP voltage at high light level (FIG. 6C). In all of these cases, gate drive 2 is not utilized.

Figure 7A:
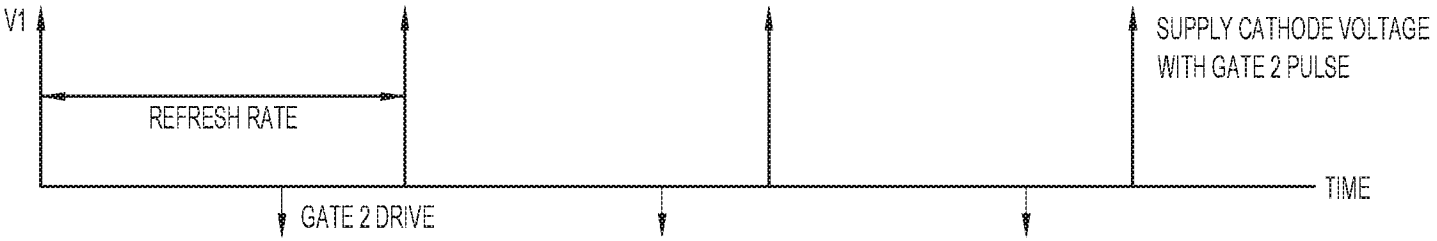
FIGS. 7A-7C show traces that depict a refresh rate and "simple" gate drive pulsing or gating of the photocathode supply voltage in accordance with an embodiment of the present invention.
Figure 7B:
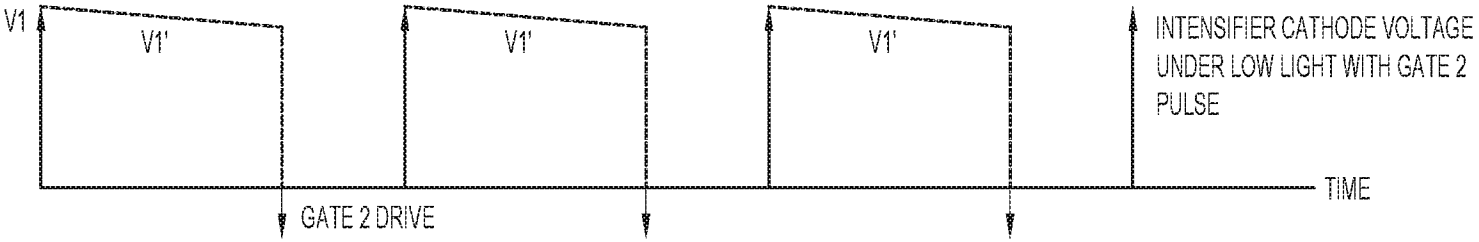
Figure 7C:
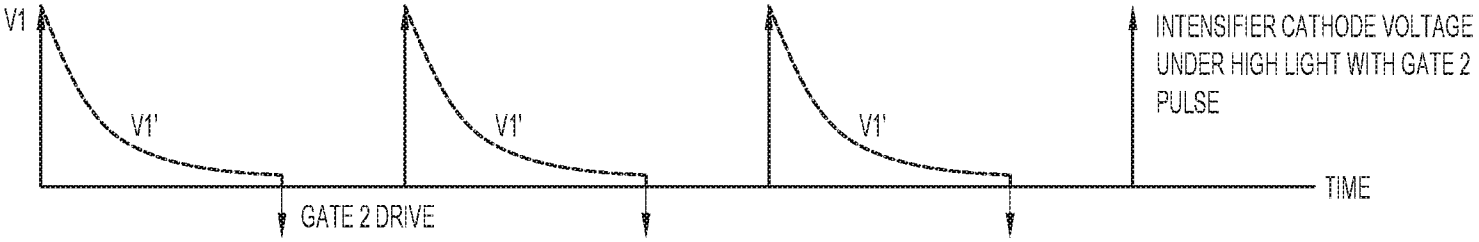
Figures 8A, 8B, 8C, 8D:
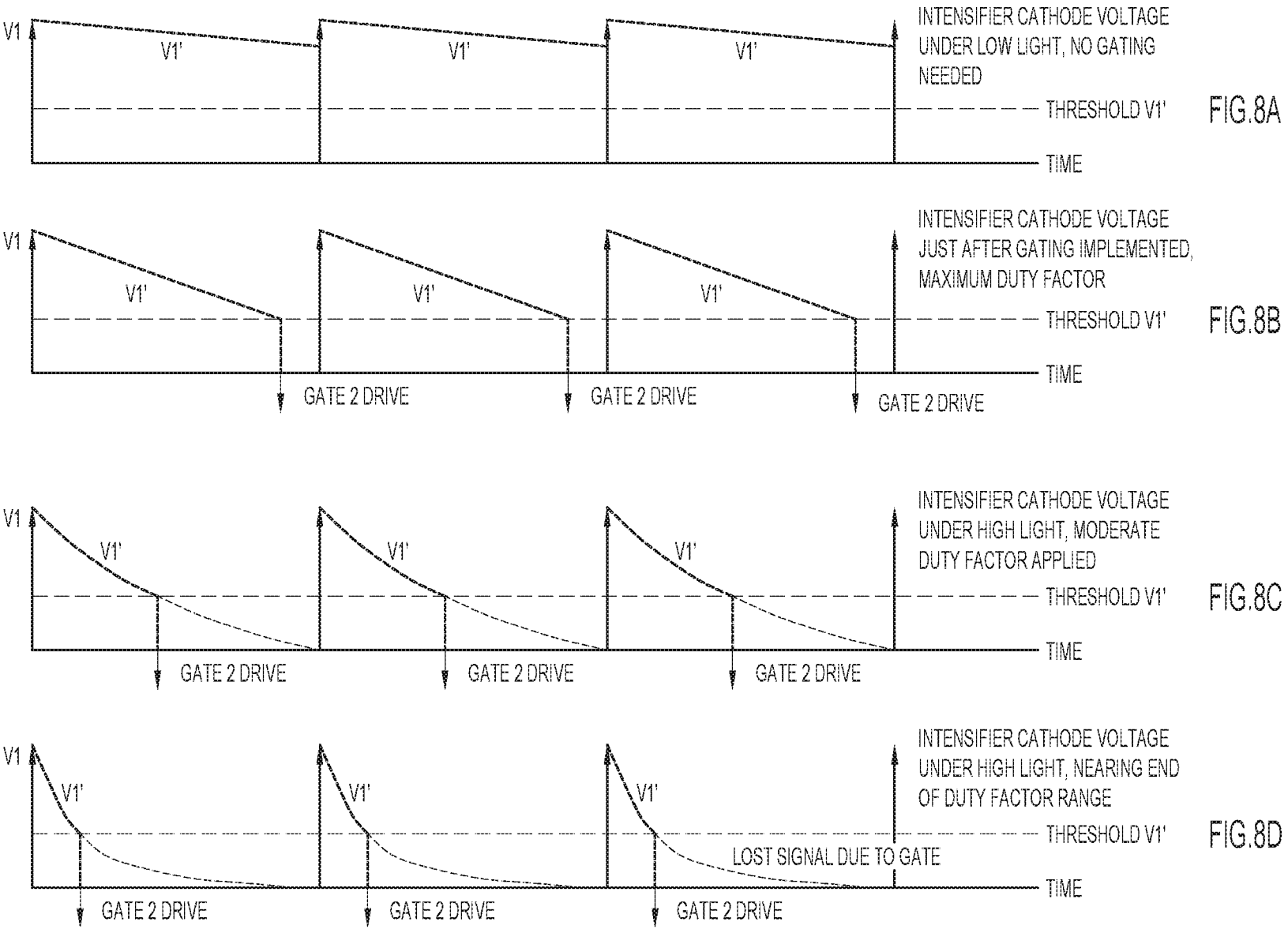
FIGS. 8A-8D show traces that depict a refresh rate and "intelligent" gate drive pulsing or gating of the photocathode supply voltage in accordance with an embodiment of the present invention.

FIGS. 7A-7C show three traces that depict the refresh rate and gate drive 2 "simple" pulsing or gating of the cathode supply (FIG. 7A), the V1' voltage with gate drive 2 pulsing at low light level (FIG. 7B), and the V1' voltage with gate drive 2 pulsing at high light level (FIG. 7C). The traces show the VP voltage when a fixed (simple) time interval is used on the gate drive 2 to reduce the performance of the intensifier tube to, e.g., meet export control regulations. Specifically, under low light conditions where SNR is more important, the gate drive 2 is pulsed. This drives the intensifier photocathode voltage into reverse bias shutting off the photocathode signal to the rest of the intensifier tube (FIG. 7B), effectively lowering the SNR by the fixed duty factor. As the light level increases, the effect of this fixed gating factor becomes less effective (FIG. 7C), but at that point there is enough signal that having an intensifier is less important. The implementation of this gating scheme may be thought of as a performance selection function (which can be used, as desired, to degrade the performance of a given night vision device). The foregoing approach is referred to as "simple" gating as there is no feedback mechanism driving the timing of the gate drive 2 pulse. The pulse frequency is fixed, and that frequency value may be stored as one of the settings 185. At very high light levels, the gate drive 2 pulse has virtually no effect on the output of the intensifier tube because the V1' voltage has already decayed back to the V2 supply voltage.

FIGS. 8A-8D show traces that depict the refresh rate (FIG. 8A) and gate drive 2 "intelligent" pulsing or gating of the cathode supply, the V1' voltage with gate drive 2 pulsing at maximum duty factor (FIG. 8B), the V1' voltage with gate drive 2 pulsing at moderate duty factor (FIG. 8C), and the V1' voltage with gate drive 2 pulsing nearing the end of the duty factor range. In "intelligent" gating, the CPU 160 assesses the output current (I3) and associates that current with a threshold V1' associated with photocathode current that would cause damage to the photocathode emissive surface. In this case, as the photocathode voltage sags toward the threshold voltage (associated with current through the relationship $C\Delta V1'/\Delta t$) the CPU 160 opens gate drive 2 and forces the V1' to be reversed bias shutting down the photocathode current flow (e.g., FIG. 8B). As mentioned previously, this implementation of intelligent gating does not produce audible emissions until it starts to gate because the supply is in DC mode until the threshold voltage is reached. The final two traces (FIGS. 8C and 8D) show V1' under higher light conditions. In these cases, the dashed V1' traces are displayed for reference to show how much signal is lost by implementing the gate drive 2 pulse.

As will be appreciated by those skilled in the art, the use of the different settings including threshold V1', and other adjustable parameters, adds flexibility to power supply 150 to maintain the maximum signal when needed, but still limit the output brightness to the user's eyes when so desired. Alternatively, the parameters can be set such that low light signal to noise is capped, but all other parameters are similar. All in all, the power supply 150 may be configured to adjust at least any one or more of the following parameters:

- Low light V1 set point—controls SNR and low light resolution
- High light V1 set point—controls high light resolution
- Selectable DC operation of V1 until, e.g., $1\times10^{-3}$ fc—controls audibility
- Refresh rate of V1—controls high light resolution, audibility, and flash response The power supply 150 may also be configured to adjust or manipulate the following waveforms:

Fixed duty factor gating of V1 (simple gating)

Anode current (I3) controlled gating factor or V1—high light control (intelligent gating)

Figure 9:
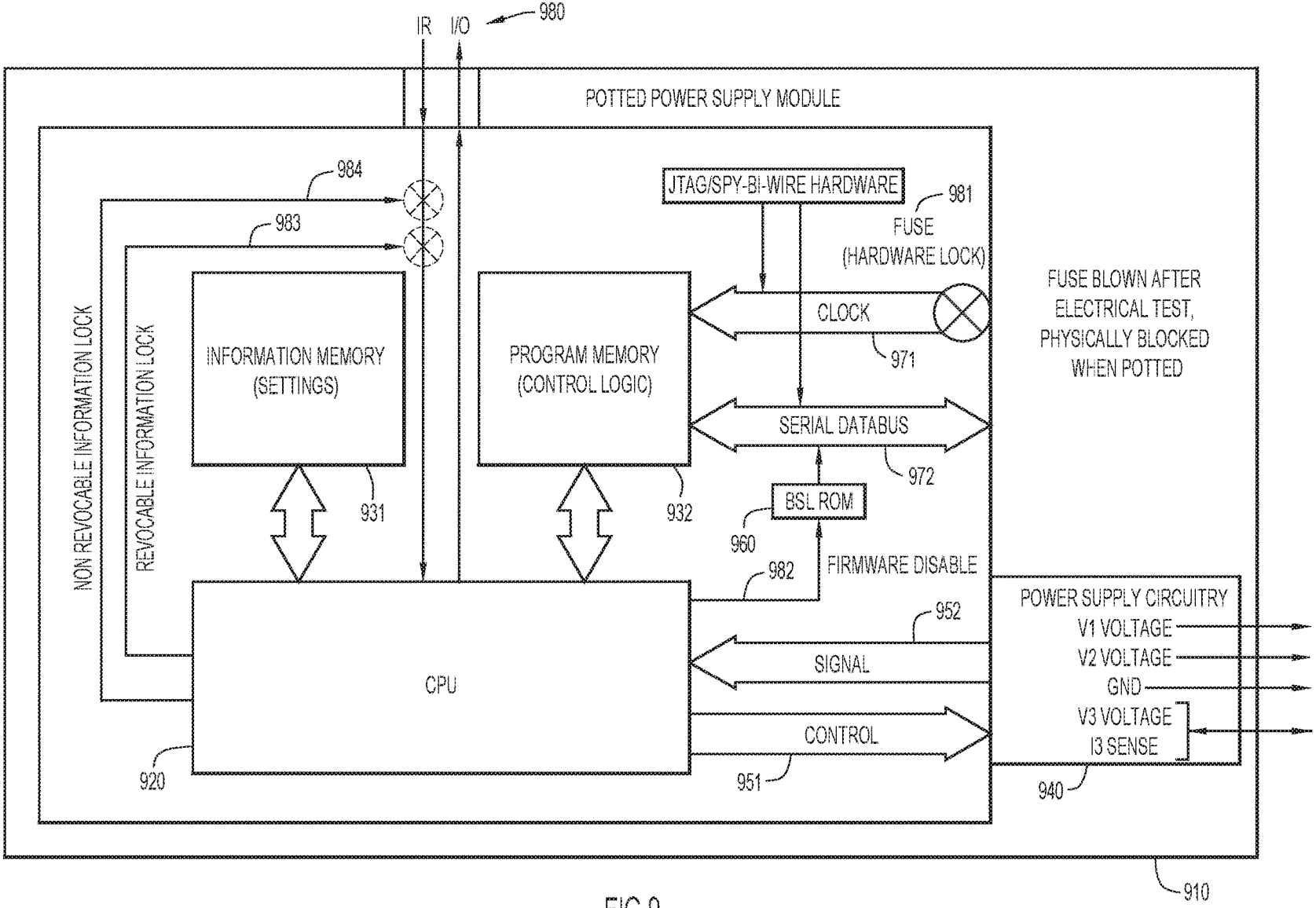
FIG. 9 is another block diagram of a digitally controlled power supply including security locking functions in accordance with an embodiment of the present invention.

Source detachable V1 (provides light driven decay of photocathode voltage)—controls high light resolution and audibility FIG. 9 is another block diagram of a digitally controlled power supply including security locking functions in accordance with an embodiment of the present invention. In FIG. 9, power supply 910 includes a CPU 920 in communication with memory including information memory (settings) 931 and program memory (control logic) 932. The CPU 920 is in communication with power supply circuitry 940 via a control bus 951 and signal bus 952. Power supply circuitry 940 is configured to generate the desired control voltages (e.g., V1, V2) under the control of CPU 920. In this regard, control bus 951 may carry control signals regarding how power supply circuitry 940 should set or modify the control voltages, V1 and V2. Signal bus 952 may carry signals including, e.g., I3 sense back to CPU 920. It is noted that the figure is schematic in nature and thus does not depict any signal conditioning that may be applied to signals communicated between CPU 920 and power supply circuitry 940 (e.g., an operation amplifier like that shown I FIG. 1).

Also shown in FIG. 9 is bootstrap logic (BSL) read-only memory (ROM) 960, a clock interface 971 and serial data bus interface 972 enabling the memory 931, 932 to be initialized via an external interface (not shown). Clock interface 971 and serial data bus interface 972 may be configured as a Joint Test Action Group (JTAG) or Spy-Bi-Wire interface. Still further shown is infrared input/output (I/O) port 980, which likewise enables memory 931 to be updated using an IR external device (not shown).

As noted, in certain cases, the performance of a night vision device might need to be constrained or degraded to meet, e.g., export restrictions. In view of the functionality of the digitally controlled power supply 150 discussed above, it is possible to store settings in memory 931 and/or configure control logic in memory 932 such that a given night vision device operates at sub-optimum performance. Of course, once such a device leaves a manufacturer, it might nevertheless be possible for a user or other entity in the supply chain to reprogram or reconfigure the device so that it once again performs to its fullest potential. To ensure that a performance-degraded night vision device cannot be upgraded, several security locking functions may be implemented in power supply 910.

In an embodiment, three separate locks may be implemented to safeguard stored settings and stored control logic of the power supply 910, thus ensuring that the performance of an associated night vision device is not impermissibly upgraded.

The first locking function is a hardware fuse 981 which may be blown once the control logic is entered into the memory 932. Once blown, the power supply 910 cannot accept new programming nor is it possible to recover the control logic via direct hardware connection. Moreover, the fuse and its associated clock programming port 971 are encapsulated, during the power supply manufacturing process, as a further physical security measure.

The second and third locking functions 983, 984 are software based. These two locks control whether the power supply 910 will accept new parameters specific to the intensifier tube mated to the power supply 910. A revocable lock 983 can be set with a password that is, e.g., two 16 bit words in length. When revocable lock 983 is open, the power supply 910 will accept IR commands, e.g., via I/R port 980, which can be used to set the operating mode, V1 and V2 set points, screen current (max I3), maximum gain (max V2), V1 refresh rate, and other parameters. Once revocable lock 983 is closed the only user programmable factors, in accordance with one implementation, are the maximum gain and limited readback functions. If several attempts (e.g., three) are made to crack the revocable lock 983 using an incorrect password, then the non-revocable lock 984 may be activated. In an embodiment, engaging non-revocable lock 984 causes portions of the IR read code to be inoperable (e.g., no setting values can be read but serial numbers, general operating status are operable). Under the non-revocable lock 984, and in one implementation, not even factory codes can force the power supply 910 to accept new parameters through the IR programming port 980. Similar to the state where the revocable lock 983 is engaged, the supply may still accept maximum gain and limited readback commands but nothing else.

The fuse 982 may be blown immediately after the proper loading of the code has been verified during the manufacturing process.

Figure 10:
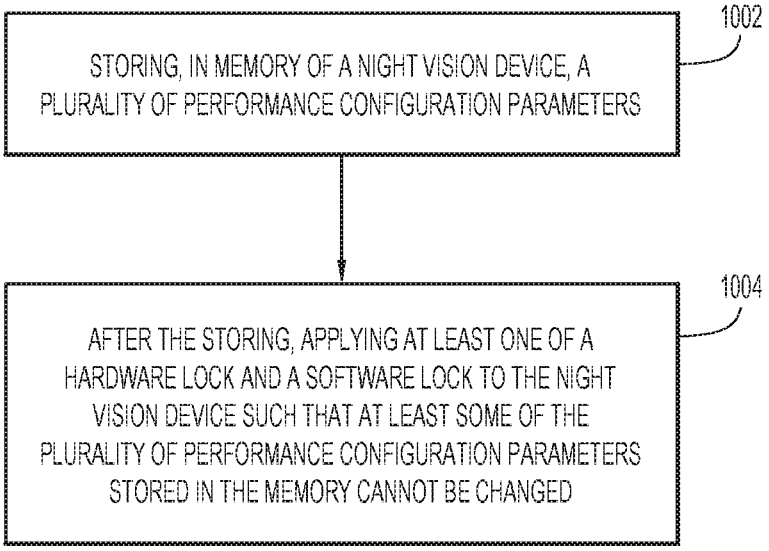
FIG. 10 is a flowchart depicting a series of operations or a process for controlling the performance of a night vision device in accordance with an embodiment of the present invention.

FIG. 10 is a flowchart depicting a series of operations or a process for controlling the performance of a night vision device in accordance with an embodiment of the invention. At 1002, the process includes storing, in memory of the night vision device, a plurality of performance configuration parameters. At 1004, the process includes, after the storing, applying at least one of a hardware lock and a software lock to the night vision device such that at least some of the performance configuration parameters stored in the memory cannot be changed.

In sum, the embodiments described herein provide a digitally controlled power supply for a light intensifier tube that provides multiple light level management processes, based on a plurality of adjustable parameters, for controlling the performance of a night vision device, and for ensuring that an intended level of performance is not impermissibly changed.

Although the disclosed inventions are illustrated and described herein as embodied in one or more specific examples, it is nevertheless not intended to be limited to the details shown, since various modifications and structural changes may be made therein without departing from the scope of the inventions and within the scope and range of equivalents of the claims. In addition, various features from one of the embodiments may be incorporated into another of the embodiments. Accordingly, it is appropriate that the appended claims be construed broadly and in a manner consistent with the scope of the disclosure as set forth in the following claims.

What is claimed:

1. A power supply for an image intensifier of a night vision device, the power supply comprising:

a processor;

power supply circuitry, under the control of the processor, that is configured to supply a control voltage to the image intensifier;

a memory, in communication with the processor, configured to store control logic and a performance parameter; and wherein the processor is configured to execute the control logic in accordance with the performance parameter to control the power supply circuitry to supply the control voltage to the image intensifier, and to apply a revocable software lock using a password, wherein the revocable software lock precludes, without the password, the performance parameter from being changed.

2. The power supply of claim 1, wherein the control voltage is a control voltage supplied to a photocathode of the image intensifier.

3. The power supply of claim 1, wherein the performance parameter is configured to control a refresh rate of the control voltage.

4. The power supply of claim 1, wherein the performance parameter is configured to control a gating factor for the control voltage.

5. The power supply of claim 4, wherein the performance parameter is configured to apply a fixed gating factor for the control voltage.

6. The power supply of claim 4, wherein performance parameter is configured to apply the gating factor for the control voltage based on a predetermined threshold.

7. The power supply of claim 1, wherein the performance parameter is a low light photocathode voltage set point for the image intensifier of the night vision device.

8. The power supply of claim 1, wherein the performance parameter is a high light photocathode voltage set point for the image intensifier of the night vision device.

9. The power supply of claim 1, further comprising one of a hardware lock and a software lock that precludes the control logic and the performance parameter from being changed.

10. The power supply of claim 9, wherein the hardware lock comprises a blown fuse disposed in a path of at least one of a clock line and a data bus connecting the memory to an external interface of the night vision device.

11. A method of controlling the performance of a night vision device, comprising:

storing, in memory of the night vision device, a plurality of performance configuration parameters;

after the storing, applying at least one of a hardware lock and a software lock to the night vision device such that at least some of the plurality of performance configuration parameters stored in the memory cannot be changed; and when applying the software lock, applying a revocable software lock using a password, wherein the revocable software lock precludes, without the password, at least some of the plurality of performance configuration parameters from being changed.

12. The method of claim 11, further comprising, when applying the hardware lock, blowing a fuse disposed in a path of at least one of a clock line and a data bus connecting the memory to an external interface of the night vision device.

13. The method of claim 11, further comprising, after receiving an incorrect password a predetermined number of times, applying an irrevocable software lock such that use of the password no longer permits at least some of the plurality of performance configuration parameters from being changed.

14. The method of claim 11, further comprising storing, in the memory, program code; and after storing the program code, applying the at least one of the hardware lock and the software lock to the night vision device such that the program code stored in the memory cannot be changed.

15. The method of claim 14, wherein the program code controls at least one of a fixed duty factor gating of a photocathode voltage for a light intensifier tube of the night vision device, and an anode current controlled gating factor for the photocathode voltage for the light intensifier tube of the night vision device.

16. The method of claim 11, wherein the plurality of performance configuration parameters comprises at least one of a low light photocathode voltage set point, a high light photocathode voltage set point, and a refresh rate of the photocathode voltage.

* * * * *